US008487972B2

(12) United States Patent
Aoki et al.

(10) Patent No.: US 8,487,972 B2
(45) Date of Patent: Jul. 16, 2013

(54) DECOLORING APPARATUS, IMAGE FORMING APPARATUS, AND DECOLORING METHOD

(75) Inventors: Takayasu Aoki, Shizuoka-ken (JP); Koji Imamiya, Kanagawa-ken (JP); Noboru Furuyama, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 247 days.

(21) Appl. No.: 13/093,182

(22) Filed: Apr. 25, 2011

(65) Prior Publication Data

US 2011/0261133 A1 Oct. 27, 2011

Related U.S. Application Data

(60) Provisional application No. 61/328,370, filed on Apr. 27, 2010.

(51) Int. Cl.
*B41J 29/16* (2006.01)

(52) U.S. Cl.
USPC ..... 347/179

(58) Field of Classification Search
USPC ..... 347/171, 179, 193, 213, 220
See application file for complete search history.

(56) References Cited

U.S. PATENT DOCUMENTS

| | | | | |
|---|---|---|---|---|
| 4,661,824 | A * | 4/1987 | Kuge | 347/193 |
| 5,886,727 | A * | 3/1999 | Dobashi et al. | 347/213 |
| 6,550,380 | B2 * | 4/2003 | Kinoshita et al. | 347/171 |
| 7,408,565 | B2 * | 8/2008 | Takahashi | 347/220 |
| 2005/0191082 | A1 | 9/2005 | Takayama et al. | |
| 2010/0209839 | A1 | 8/2010 | Kabai et al. | |

FOREIGN PATENT DOCUMENTS

| | | | | |
|---|---|---|---|---|
| JP | 406255142 | A * | 3/1993 | 347/179 |
| JP | 2000-238302 | | 9/2000 | |
| JP | 2001-130037 | | 5/2001 | |
| JP | 2006-281566 | | 10/2006 | |

OTHER PUBLICATIONS

Invitation Pursuant to Rule 62a(1) EPC for European Application No. 11 163 246.9-2216, dated Feb. 6, 2013, 2 pgs.

* cited by examiner

*Primary Examiner* — Kristal Feggins
(74) *Attorney, Agent, or Firm* — Turocy & Watson, LLP

(57) ABSTRACT

According to one embodiment, a decoloring apparatus includes: a heating rotating member having roughness (Rz) of a surface, which comes into contact with a conveyed sheet, equal to or larger than 3.5 μm and equal to or smaller than 6.0 μm and configured to heat and decolor a decolorable colorant on the sheet; and a pressing member configured to come into press contact with the heating rotating member to form a nip section between the pressing member and the heating rotating member and cooperate with the heating rotating member to nip and convey the sheet.

20 Claims, 6 Drawing Sheets

FIG.6

| | EXAMPLE1 | EXAMPLE2 | EXAMPLE3 | EXAMPLE4 | COMPARATIVE EXAMPLE1 | COMPARATIVE EXAMPLE2 |
|---|---|---|---|---|---|---|
| CONFIGURATION OF DECOLORING APPARATUS | DECOLORING APPARATUS | DECOLORING APPARATUS | IMAGE FORMING APPARATUS | DECOLORING APPARATUS | DECOLORING APPARATUS | DECOLORING APPARATUS |
| CONFIGURATION OF HEATING ROTATING MEMBER | BELT | ROLLER | BELT | BELT | BELT | BELT |
| MATERIAL OF SURFACE OF HEATING ROTATING MEMBER | SILICONE RUBBER | PTFE RESIN | SILICONE RUBBER | SILICONE RUBBER | PFA | SILICONE RUBBER |
| Rz VALUE | 4.582 | 3.895 | 4.582 | 5.651 | 3.152 | 7.352 |
| GLOSS LEVEL AFTER DECOLORING PROCESS | 7 | 9 | 7 | 6 | 15 | 5 |
| ADHESION OF DECOLORABLE COLORANT TO ROTATING MEMBER | A | A | A | A | A | B |
| OCCURRENCE OF JAM | A | A | A | A | A | B |

DECOLORING APPARATUS, IMAGE FORMING APPARATUS, AND DECOLORING METHOD

CROSS-REFERENCE TO RELATED APPLICATION

This application is based upon and claims the benefit of priority from: U.S. provisional application 61/328,370, filed on Apr. 27, 2010; the entire contents all of which are incorporated herein by reference.

FIELD

Embodiments described herein relate generally to a decoloring apparatus that erases a color of an image formed using a decolorable colorant, a color of which is erased by heat.

BACKGROUND

In the past, in order to make it possible to reuse paper printed for the purpose of temporary transmission, display, and the like of information, for example, a heat sensitive recording medium (thermal recording paper), printing on which is erased by heat, and a pigment, color of which is erased by heating, are used.

Further, as a toner of an image forming apparatus such as a MFP (Multi Function Peripheral), a so-called decolorable toner, a color of which is erased by heating, is also used. Since a sheet on which an image is formed with the decolorable toner is decolored by heating, the sheet can be reused after being decolored.

However, the decolorable toner in the past has insufficient decoloring performance. For example, a gloss in a decolored portion of an image formed on a sheet is conspicuous.

DESCRIPTION OF THE DRAWINGS

FIG. 6 is a table of test results.

DETAILED DESCRIPTION

In general, according to one embodiment, a decoloring apparatus includes a heating rotating member and a pressing member.

The heating rotating member has roughness (Rz) of a surface, which comes into contact with a conveyed sheet, equal to or larger than 3.5 μm and equal to or smaller than 6.0 μm and heats and decolors a decolorable colorant on the sheet. The pressing member comes into press contact with the heating rotating member to form a nip section between the pressing member and the heating rotating member and cooperates with the heating rotating member to nip and convey the sheet.

Embodiments are explained below with reference to the accompanying drawings.

First Embodiment

A first embodiment is explained.

Figure 1:
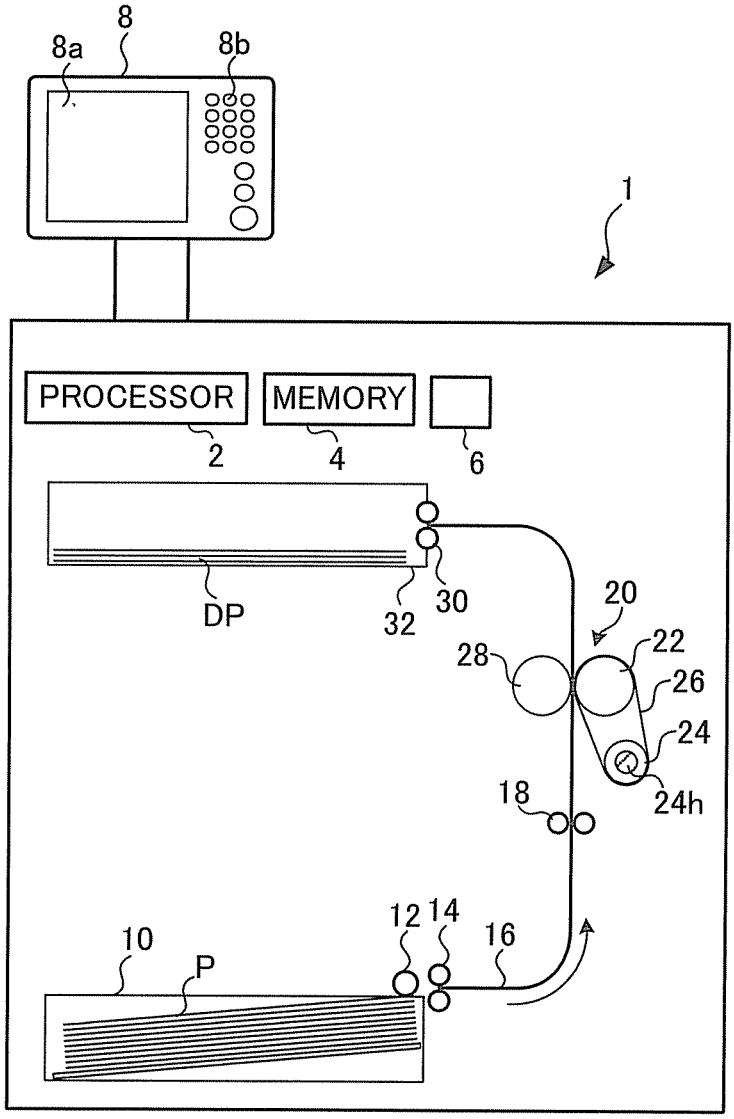
FIG. 1 is a diagram of the configuration of a decoloring apparatus according to an embodiment.

FIG. 1 is a diagram of the configuration of a decoloring apparatus 1 according to this embodiment.

The decoloring apparatus 1 applies, to a sheet on which an image is formed with a "decolorable colorant", which is a so-called decolorable toner, a decoloring process for erasing a color of the decolorable colorant.

The decoloring apparatus 1 includes a processor 2, a memory 4, an auxiliary storage device 6, an operation panel 8, a paper feeding cassette 10, a pickup roller 12, a decoloring section 20, and a discharge tray 32.

The processor 2 is a processing device configured to control the decoloring process in the decoloring apparatus 1. The processor 2 executes computer programs stored by the memory 4 and the auxiliary storage device 6 to thereby realize various functions and execute processes.

As the processor 2, for example, a CPU (Central Processing Unit) or an MPU (Micro Processing Unit) that can execute arithmetic processing equivalent to that of the CPU is used. As the processor 2, an ASIC (Application Specific Integrated Circuit) may be used. If the ASIC is used as the processor 2, the ASIC can realize a part or all of functions of the decoloring apparatus 1.

The memory 4 is a so-called main storage device. The memory 4 as the main storage device stores a computer program for the processor 2 to execute the decoloring process in the decoloring apparatus 1. The memory 4 provides the processor 2 with a temporary work area. As the memory 4, for example, a RAM (Random Access Memory), a ROM (Read Only Memory), a DRAM (Dynamic Random Access Memory), an SRAM (Static Random Access Memory), a VRAM (Video RAM), or a flash memory is used.

The auxiliary storage device 6 stores various kinds of information in the decoloring apparatus 1. The auxiliary storage device 6 may store the computer program stored by the memory 4. As the auxiliary storage device 6, for example, a magnetic storage device such as a hard disk drive, an optical storage device, a semiconductor storage device (a flash memory, etc.), or a combination of these storage devices is used.

The operation panel 8 includes a display section 8*a* of a touch panel type and various operation keys 8*b*. The display section 8*a* displays, for example, a setting screen for setting conditions for the decoloring process in the decoloring apparatus 1 and an operation state of the decoloring apparatus 1. The operation keys 8*b* include, for example, a ten key, a reset key, a stop key, and a start key. A user can perform, using the touch panel of the display section 8*a* or the operation keys 8*b*, operation input to the setting screen or the like displayed on the display section 8*a* and operation input for instructing execution of the decoloring process.

The paper feeding cassette 10 is a cassette configured to store sheets P to be subjected to the decoloring process by the decoloring apparatus 1.

The sheets P to be subjected to the decoloring process are sheets on which images are formed with a decolorable colorant such as a decolorable toner, a color of which is erased by heating. Since the color of the decolorable colorant on the surface of a sheet is erased by the decoloring process in the decoloring apparatus 1, reuse of the sheet is possible, for example, image formation can be performed on the sheet again.

Like a paper feeding cassette of a MFP (Multi Function Peripheral), the paper feeding cassette 10 may be configured to be drawn out to the outside of the apparatus to place sheets thereon.

The pickup roller 12 picks up sheets from the paper feeding cassette 10 one by one and feeds the sheet to a conveying path 16 through which the sheet is conveyed. The sheet fed to the conveying path 16 is conveyed to the decoloring section 20 by conveying roller pairs such as conveying rollers 14 and 18.

The decoloring section 20 heats the sheet and erases the color of the deplorable colorant fixed on the surface of the sheet. The decoloring section 20 includes a roller 22, a heating roller 24 serving as a heating rotating member, a heating belt 26, and a pressing roller 28 serving as a pressing member.

The roller 22 is a roller around which the heating belt 26 is wound and suspended. The roller 22 is arranged to be opposed to the pressing roller 28. The roller 22 applies, in cooperation with the pressing roller 28 opposed thereto, pressure to the sheet conveyed to the roller 22. As the roller 22, for example, a roller formed by providing a heat-resistant elastic layer made of silicon sponge on a cored bar can be used. As the heat-resistant elastic layer, a heat-resistant elastic layer not having very high hardness is desirable in order to secure a wide nip section.

The heating roller 24 is a roller around which the heating belt 26 is wound and suspended. The heating roller 24 heats the heating belt 26. The heating roller 24 includes a heater **24*h* that generates heat. The surface of the heating roller 24 is heated by the heater 24*h*. The heating belt 26 is heated by the heat of the heating roller 24. As the heating roller 24, a roller formed by coating a hollow cored bar of aluminum or iron with a film layer of PTFE (polytetrafluoroethylene) for wear prevention can be used. In order to further reduce warm-up time for the decoloring apparatus 1, as the heating roller 24, a roller having a low heat capacity such as a thin roller is desirable. As the heater 24*h***, for example, a halogen heater lamp can be used.

At least one of the roller 22 and the heating roller 24 is driven to rotate by a driving source such as a motor and rotates the heating belt 26.

The heating belt 26 is an endless belt that is wound and suspended around the roller 22 and the heating roller 24 to rotate and nips and conveys a sheet in cooperation with the pressing roller 28 opposed thereto. The heating belt 26 heats the sheet, which passes through a nip section between the heating belt 26 and the pressing roller 28, to temperature equal to or higher than decoloring temperature, at which the decolorable colorant is decolored, to erase the color of the decolorable colorant.

The heating belt 26 in this embodiment has a function of roughening the surface of the decolorable colorant to reduce a gloss of the decolorable colorant in addition to a function of erasing the color of the decolorable colorant on the sheet.

The color of the decolorable colorant can be erased by the decoloring process. However, the fixed colorant itself does not disappear. The colorant remains on the sheet even after the decoloring process. If the surface of the decolorable colorant fixed on the sheet is smooth, the decolorable colorant reflects light and is conspicuous even if the color is erased by the decoloring process. Therefore, the surface of the decolorable colorant is roughened.

Therefore, the heating belt 26 in this embodiment has, in order to roughen the surface of the decolorable colorant, scatter light, and reduce a gloss, very small unevenness on the surface that comes into contact with the sheet. Since the decolorable colorant fixed on the sheet is heated by the heating belt 26 having the very small unevenness, the color of the decolorable colorant fixed on the sheet is erased, the gloss is reduced, and the decolorable colorant is made less conspicuous after the decoloring process.

Figure 2:
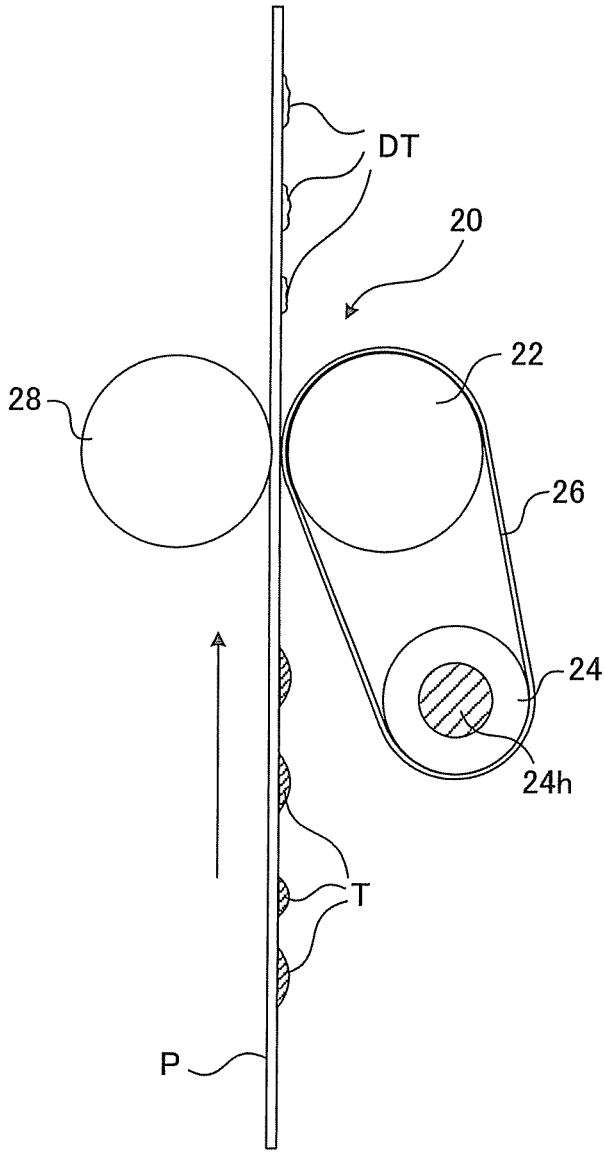
FIG. 2 is a schematic diagram of a decoloring section.

A schematic diagram of the decoloring section 20 is shown in FIG. 2.

The sheet P is nipped and conveyed by the heating belt 26 and the pressing roller 28. The surface to which a decolorable colorant T adheres is heated by the heating belt 26 and subjected to the decoloring process. Consequently, the decolorable colorant is decolored. Further, since the heating belt 26 has the very small unevenness on the surface as explained above, the surface of the decolorable colorant T is deformed in to an uneven shape by the heating belt 26 when the decolorable colorant T passes through the nip section. In FIG. 2, the decolorable colorant T after passing through the nip section is schematically shown as a decolorable colorant DT having the uneven surface. The decolorable colorant T is solid at the room temperature. However, when heated by the heating belt 26, the decolorable colorant T is softened and easily deformed by the unevenness on the surface of the heating belt 26.

In order to roughen the surface of the decolorable colorant T and reduce the gloss, the heating belt 26 desirably has an Rz value, which indicates the roughness of the surface of the heating belt 26, equal to or larger than 3.5 μm and equal to or smaller than 6.0 μm.

If the Rz value of the heating belt 26 is equal to or larger than 3.5 μm, the surface of the decolorable colorant T can be roughened to have a surface characteristic for scattering light and the gloss can be suppressed.

If the Rz value is equal to or smaller than 6.0 μm, it is possible to more surely prevent the decolorable colorant T from peeling from the surface of the sheet and adhering to the surface of the heating belt 26. If the Rz value exceeds 6.0 μm, in some cases, the decolorable colorant T on the sheet adheres to the heating belt 26 and a jam during sheet conveyance tends to occur.

As the heating belt 26, for example, a belt including, as a base material, an electrocast product containing nickel as a material, a stainless steel material, a polyimide material, or the like and having a heat resistant elastic layer of silicone rubber on the outer circumferential surface of the base material can be used.

The heating belt 26 may be a belt obtained by coating the outermost layer with fluorine resin having high releasability such as a PFA (fluorine resin) tube to improve releasability.

The roughness of the surface of the heating belt 26 can be adjusted to predetermined roughness by, for example, polishing the surface of the outermost layer of the heating belt 26 with a polishing material such as polishing paper.

The pressing roller 28 applies pressure to the sheet nipped and conveyed by the pressing roller 28 and the heating belt 26. The pressing roller 28 is brought into contact with and pressed against the heating belt 26 by a not-shown pressing mechanism. The pressing roller 28 is formed by coating a hollow cored bar of aluminum or iron with silicone rubber. The outer side of the silicone rubber layer may be coated with a PFA tube for improving releasability.

The pressing roller 28 may also include heating means such as a heater and heat the sheet in cooperation with the heating belt 26.

The pressing roller 28 is driven to rotate by a driving source such as a motor. Peeling means such as a peeling blade configured to peel the sheet may be arranged in the pressing roller 28.

The sheet having the reduced gloss and subjected to the decoloring process by the decoloring section 20 is conveyed by a conveying roller pair such as a conveying roller 30 and discharged to the discharge tray 32. Decolored sheets DP having the reduced gloss and subjected to the decoloring process are placed on the discharge tray 32. The discharge tray 32 may be able to be drawn out from the decoloring apparatus 1 to allow the sheets DP subjected to the decoloring process to be picked up. An opening communicating with the outside of the decoloring apparatus 1 may be provided to allow the sheets DP to be directly picked up from the discharge tray 32.

The configuration of the decoloring apparatus 1 according to this embodiment is as explained above.

With the decoloring apparatus 1 according to this embodiment, it is possible not only to erase the color of the decolorable colorant but also to reduce the gloss of the colorant to be decolored. Therefore, with the decoloring apparatus 1, it is possible to provide a recycle sheet on which a decolored portion is less conspicuous.

A decolorable colorant to be subjected to the decoloring process by the decoloring apparatus 1 according to this embodiment is explained below. The decolorable colorant explained below is an example. The decolorable colorant may be any colorant that is a decolorable colorant decolored by heat, contains resin, and keeps a gloss.

As the decolorable colorant, a decolorable colorant containing at least an electron-donating color assuming agent, an electron-accepting color developing agent, and binder resin (binding resin) can be used.

The electron-donating color assuming agent is a precursor compound of a coloring matter for displaying characters, figures, and the like. As the electron-donating color assuming agent, a leuco dye can be mainly used. The leuco dye is an electron-donating compound that can develop a color with a color developing agent. Examples of the leuco dye include diphenylmethane phthalide, phenylindolyl phthalide, indolyl phthalide, diphenylmethane azaphthalide, phenylindolyl azaphthalide, fluoran, styrynoquinoline, and diazarhodaminelactone.

The electron-accepting color developing agent is an electron-accepting compound that colors a color assuming agent according to a mutual action with the color assuming agent.

The electron-accepting color developing agent is an electron-accepting compound that gives proton to the leuco dye, which is the electron-donating color assuming agent.

As the electron-accepting color developing agent, for example, phenol, phenol metallic salt, carboxylate metallic salt, aromatic carboxylate acid and aliphatic carboxylate acid having carbon number 2 to 5, benzophenone, sulfonic acid, sulfonate, phosphoric acid, phosphate metallic salt, acid phosphate, acid phosphate metallic salt, phosphorous acid, phosphorous acid metallic salt, monophenol, polyphenol, 1,2,3-triazole and derivative thereof are used.

The binder resin melts in a fixing process and fixes a coloring material on a sheet.

As the binder resin, polyester resin obtained by subjecting a dicarboxylic acid component and a diole component to condensation polymerization through an esterification reaction is used. Styrene resin is disadvantageous in terms of low-temperature fixing because, in general, glass transfer temperature is high compared with the polyester resin.

Examples of the dicarboxylic acid component include aromatic dicarboxylic acid such as terephthalic acid, phthalic acid, and isophhalic acid and aliphatic carboxylic acid such as fumaric acid, maleic acid, succinic acid, adipic acid, sebacic acid, glutaric acid, pimelic acid, oxalic acid, malonic acid, citraconic acid, and itaconic acid.

Examples of the alcohol component (the diole component) include aliphatic diole such as ethylene glycol, propylene glycol, 1,4-butanediole, 1,3-butanediole, 1,5-pentanediole, 1,6-hexandiole, neopentyl glycol, trimethylene glycol, trimethylolpropane, and pentaerythritol and alicyclic diole such as 1,4-cyclohexane diole and 1,4-cyclohexane dimethanol. Examples of the alcohol component also include ethylene oxide adduct or propylene oxide adduct such as bisphenol A (bisphenol A alkylene oxide adduct).

The polyester component may be formed in a crosslinking structure using trivalent or more multiple-valued carboxylic acid or multi-valued alcohol component such as 1,2,4-benzene tricarboxyliC acid (trimellitic acid) or glycerin.

As the binder, two or more kinds of polyester resin having different compositions may be mixed and used.

An example of the decolorable colorant subjected to the decoloring process in the decoloring apparatus 1 according to this embodiment is as explained above. A sheet on which an image is formed with such a decolorable colorant can be subjected to the decoloring process with the reduced gloss by the decoloring apparatus 1 according to this embodiment.

In the embodiment explained above, the heating roller 24 configured to heat the heating belt 26 is heated by the heater **24*h*. However, heating means is not limited to this. The heating roller 24 can be heated by other heating means such as an IH coil. The heating belt 26** may be directly heated by an IH coil.

In the embodiment explained above, the heating roller 24 heats the heating belt 26. However, heating means is not limited to this. The roller 22 may be a heating roller including a heater. The roller 22 as the heating roller may heat the heating belt 26.

Second Embodiment

A second embodiment is explained below.

Figure 3:
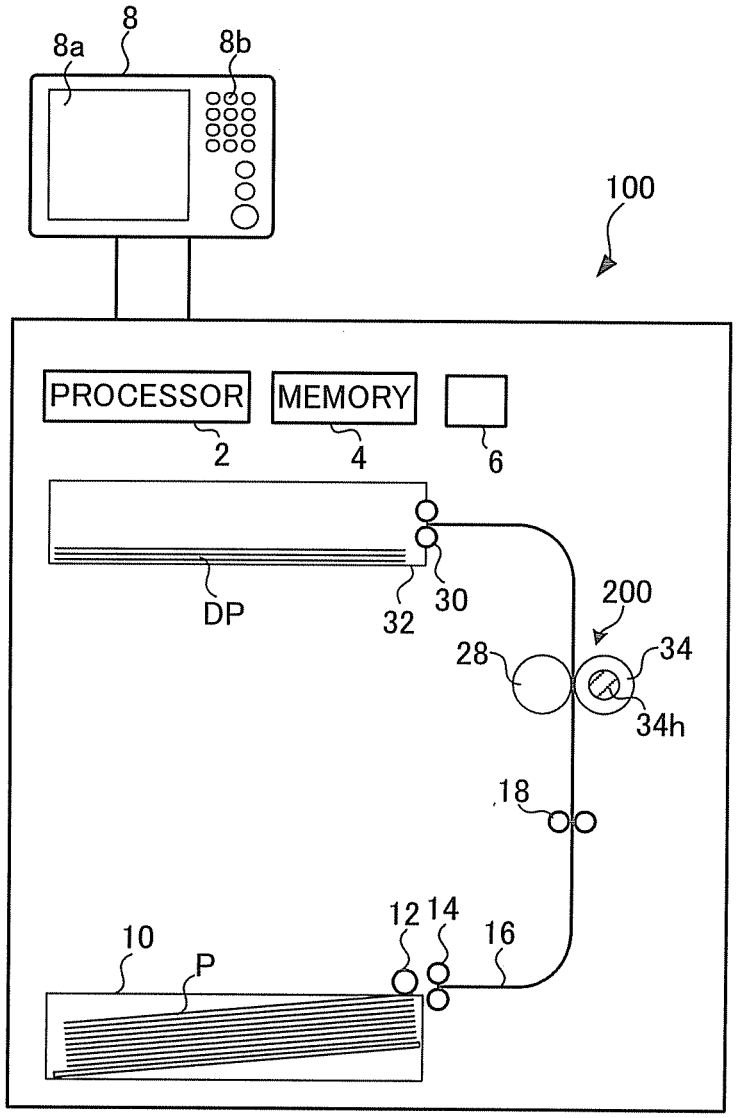
FIG. 3 is a diagram of the configuration of a decoloring apparatus according to an embodiment.

FIG. 3 is a diagram of the configuration of a decoloring apparatus 100 according to the second embodiment.

In the decoloring apparatus 100 according to the second embodiment, a decoloring section 200 has a configuration different from that of the decoloring section 20 in the first embodiment. Specifically, in the decoloring section 20 in the first embodiment, a sheet is heated and decolored by the heating belt 26. However, in the decoloring section 200 in this embodiment, a sheet is heated and decolored by a heating roller 34. The other components are the same as those of the decoloring apparatus 1 according to the first embodiment.

The heating roller 34 in this embodiment heats a sheet while nipping and conveying the sheet in cooperation with the pressing roller 28. The heating roller 34 heats the sheets at temperature equal to or higher than decoloring temperature of a decolorable colorant to erase a color of the decolorable colorant.

Like the heating belt 26 in the first embodiment, the heating roller 34 has, in order to roughen the surface of the decolorable colorant and reduce a gloss, very small unevenness on the surface that comes into contact with the sheet. Very small unevenness can be formed on the surface of the decolorable colorant by the very small unevenness to prevent light from being easily reflected and make the decolored decolorable colorant less conspicuous.

Like the heating belt 26 in the first embodiment, the heating roller 34 desirably has an Rz value, which indicates the roughness of the surface of the heating roller 34, equal to or larger than 3.5 μm and equal to or smaller than 6.0 μm. A reason for this is as explained in the first embodiment.

The heating roller 34 includes a heater 34*h* such as a halogen heater lamp. As the heating roller 34, a roller formed by coating the surface of a hollow cored bar of aluminum or iron with a film layer of PTFE can be used. In this case, the surface of the film layer of PTFE is desirably adjusted to the roughness explained above.

When the heating roller 34 is the roller having the film layer of PTFE, first, the surface of the cored bar is coated with PTFE to form a PTFE film layer and the PTFE film layer is dried and cooled. Thereafter, the roller surface is burned in a burning furnace. After the burning, the roller surface is cooled. After the cooling, the surface of the heating roller 34 is polished by a polishing material such as polishing paper to adjust an Rz value of the roller surface to the predetermined range explained above. A method of manufacturing the heating roller 34 is as explained above.

Since the other components of the decoloring apparatus 100 are the same as those of the decoloring apparatus 1 according to the first embodiment, explanation of the components is omitted.

With the decoloring apparatus 100 according to this embodiment explained above, as in the first embodiment, it is possible to erase the color of the decolorable colorant while reducing the gloss of the surface of the decolorable colorant. Therefore, it is possible to provide a sheet subjected to the decoloring process on which the decolorable colorant after the decoloring process is less conspicuous.

Third Embodiment

A third embodiment is explained below.

Figure 4:
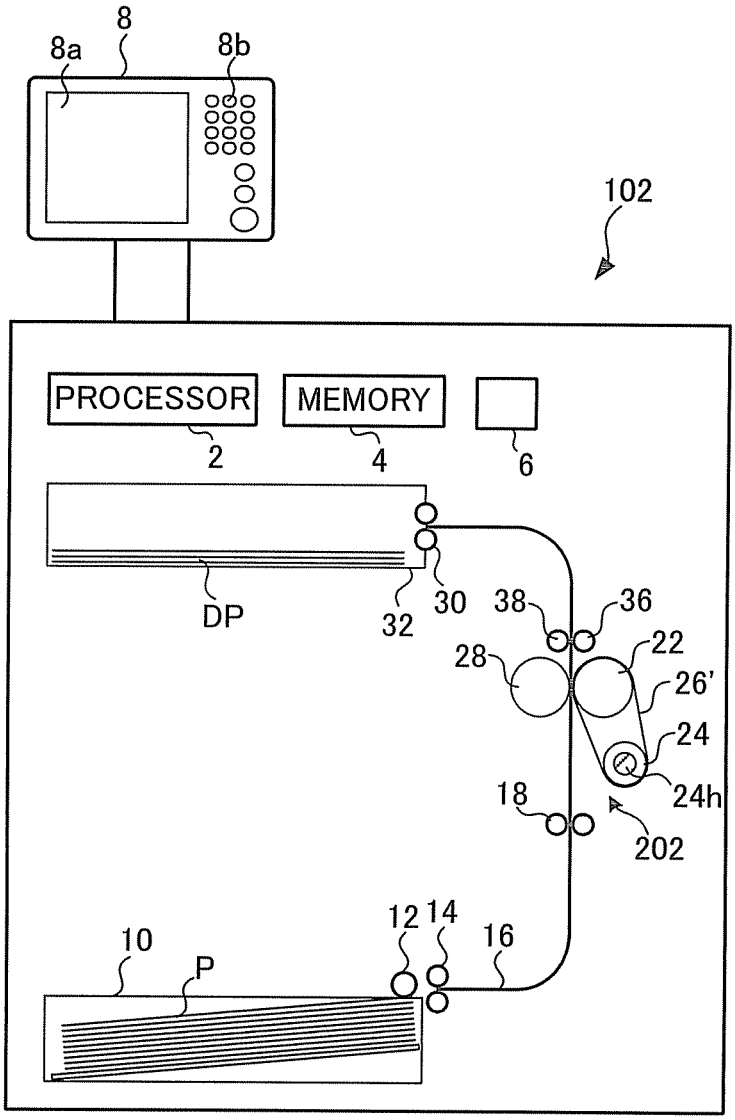
FIG. 4 is a diagram of the configuration of a decoloring apparatus according to an embodiment.

FIG. 4 is a diagram of the configuration of a decoloring apparatus 102 according to this embodiment.

The decoloring apparatus 102 according to this embodiment is different from the first and second embodiments in that a roller 36 arranged in a position on a downstream side in a sheet conveying direction with respect to the decoloring section 20 performs a process for roughening the surface of a decolorable colorant, which is a process for reducing a gloss of the surface of the decolorable colorant. The configuration of the decoloring apparatus 102 according to this embodiment is explained below.

The decoloring apparatus 102 includes a decoloring section 202, the roller 36, and an opposed roller 38 as components different from those of the decoloring apparatus 1 according to the first embodiment.

The decoloring section 202 includes the roller 22, the heating roller 24, a heating belt'26', and the pressing roller 28.

The roller 22, the heating roller 24, and the pressing roller 28 are the same as those in the first embodiment.

As in the first embodiment, the heating belt 26' heats a sheet and decolors the decolorable colorant fixed on the sheet. However, the heating belt 26' does not have very small unevenness on the surface and does not have a function for reducing the gloss of the decolorable colorant.

Instead of the heating belt 26 in the first embodiment and the heating roller 34 in the second embodiment, the roller 36 changes the surface of the decolorable colorant from a smooth state to a surface characteristic having very small unevenness and reduces the gloss of the decolorable colorant. Specifically, like the heating belt 26 in the first embodiment and the heating roller 34 in the second embodiment, the roller 36 has very small unevenness on the surface. Very small unevenness is formed on the surface of the decolorable colorant by the very small unevenness to scatter light and prevent the light from being easily reflected and make the decolored decolorable colorant less conspicuous.

Like the heating belt 26 in the first embodiment and the heating roller 36 in the second embodiment, the roller 36 desirably has an Rz value, which indicates the roughness of the surface of the roller 36, equal to or larger than 3.5 μm and equal to or smaller than 6.0 μm. A reason for this is as explained in the first embodiment.

The roller 36 is arranged further on a downstream side in a sheet conveying direction than a nip section of the decoloring section 202 together with the opposed roller 38. The roller 36 and the opposed roller 38 are desirably arranged in a position closer to the nip section of the decoloring section 202. This is because the sheet is desirably nipped and conveyed by the roller 36 and the opposed roller 38 while the temperature of the decolorable colorant heated by the heating belt 26' is higher and the decolorable colorant is easily deformed. This is because, if the temperature of the decolorable colorant falls, binder resin solidifies and hardens and, even if the very small unevenness on the surface of the roller 36 comes into contact with the decolorable colorant, the decolorable colorant is less easily deformed and, therefore, the effect of reducing the gloss by the roller 36 decreases.

The opposed roller 38 is arranged in a position opposed to the roller 36. The opposed roller 38 and the roller 36 come into contact with each other and nip and convey the sheet. Since the opposed roller 38 and the roller 36 are in contact with each other at predetermined pressure, the roller 36 comes into press contact with the sheet. The surface of the decolorable colorant can be changed from the smooth state to the surface characteristic having very small unevenness.

As explained above, with the decoloring apparatus 102 according to this embodiment, it is possible to erase the color of the decolorable colorant while reducing the gloss of the surface of the decolorable colorant. Therefore, it is possible to provide a recycle sheet on which the decolorable colorant after a decoloring process is not conspicuous.

In the embodiment explained above, the decoloring section 202 heats the sheet with the heating belt 26'. However, heating means is not limited to this. As in the second embodiment, the sheet may be heated by a heating roller rather than a belt system.

The roller 36 may be a rotating member of the belt system having very small unevenness on the surface of a belt.

Fourth Embodiment

A fourth embodiment is explained below.

Figure 5:
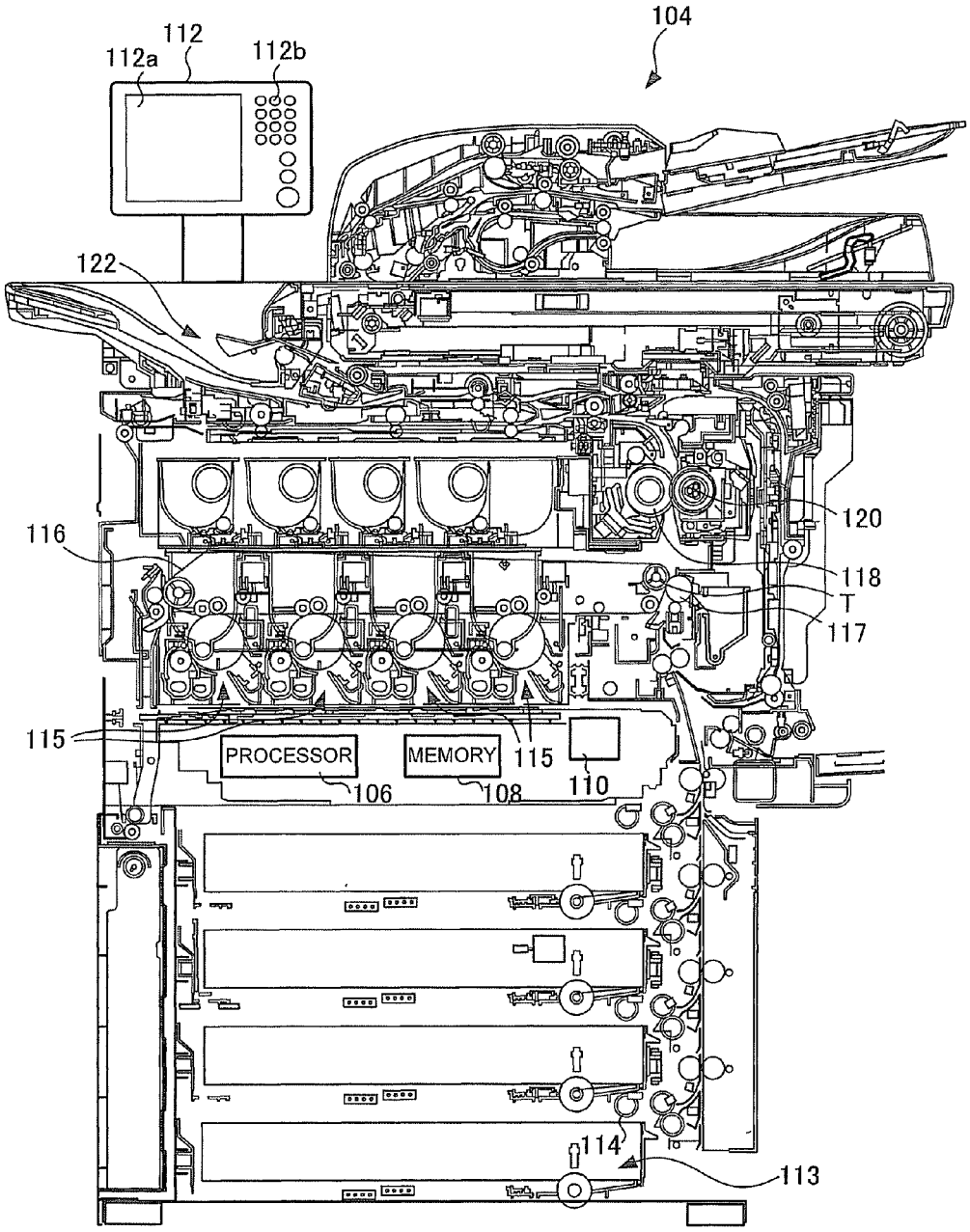
FIG. 5 is a diagram of the configuration of an image forming apparatus according to an embodiment.

FIG. 5 is a diagram of the configuration of an image forming apparatus 104 according to this embodiment.

The image forming apparatus 104 according to this embodiment performs, with a fixing section of the image forming apparatus, the decoloring process of the decoloring apparatus explained in the first to third embodiment. Specifically, the image forming apparatus 104 functions as the image forming apparatus in an operation state in which an image forming process is performed (hereinafter also referred to as image forming mode) and functions as a decoloring apparatus in an operation state in which the decoloring process is performed (hereinafter also referred to as decoloring process mode). The configuration of the image forming apparatus 104 according to this embodiment is explained below.

The image forming apparatus 104 is a so-called MFP (Multi Function Peripheral).

The image forming apparatus 104 according to this embodiment includes a processor 106, a memory 108, an auxiliary storage device 110, an operation panel 112, a paper feeding cassette 113, process units 115, an intermediate transfer belt 116, a fixing roller 118, a pressing roller 120, and a discharge tray 122.

The processor 106 is a processing device configured to control various processes in the image forming apparatus 104 such as the image forming process and an image reading process. In this embodiment, the processor 106 controls a decoloring process for erasing a color of a decolorable colorant fixed on a sheet. The processor 106 executes computer programs stored by the memory 108 and the auxiliary storage device 110 to thereby realize various functions and execute processes.

As the processor 106, for example, a CPU (Central Processing Unit) or an MPU (Micro Processing Unit) that can execute arithmetic processing equivalent to that of the CPU is used. As the processor 106, an ASIC (Application Specific Integrated Circuit) may be used. The ASIC can realize a part or all of functions of the image forming apparatus 104.

The memory 108 is a so-called main storage device. The memory 108 as the main storage device stores a computer program for the processor 106 to execute processes such as the image forming process, a sheet supplying process, and the image reading process. In this embodiment, the memory 108 also stores a computer program for the processor 106 to execute the decoloring process for erasing the color of the decolorable colorant fixed on the sheet. The memory 108 provides the processor 106 with a temporary work area. As the memory 108, for example, a RAM (Random Access Memory), a ROM (Read Only Memory), a DRAM (Dynamic Random Access Memory), an SRAM (Static Random Access Memory), a VRAM (Video RAN), or a flash memory is used.

The auxiliary storage device 110 stores various kinds of information in the image forming apparatus 104. The auxiliary storage device 110 may store the computer program stored by the memory 108. As the auxiliary storage device 110, for example, a magnetic storage device such as a hard disk drive, an optical storage device, a semiconductor storage device (a flash memory, etc.), or a combination of these storage devices is used.

The operation panel 112 includes a display section 112*a* of a touch panel type and various operation keys 112*b*. The display section 112*a* displays instruction items concerning printing conditions such as a sheet size, the number of copies, printing density setting, and finishing (stapling and folding). The operation keys 112*b* include, for example, a ten key, a reset key, a stop key, and a start key. A user can input instructions and operation concerning various processes and items displayed on the display section 112*a* from the touch panel of the display section 112*a* or the operation keys 112*b*. In this embodiment, the user can operate the operation panel 112 to designate the decoloring process mode and perform operation input for instructing the image forming apparatus 104 to execute the decoloring process.

The paper feeding cassette 113 stores sheets to be subjected to the decoloring process. A paper feeding cassette configured to store sheets to be subjected to the decoloring process is not limited to the paper feeding cassette 113 at the bottom shown in FIG. 5. Another paper feeding cassette may be used as the paper feeding cassette configured to store the sheets to be subjected to the decoloring process. The sheets to be subjected to the decoloring process may be supplied from a manual paper feeding section.

The process units 115 form developer images on photoconductive members and transfer the developer images onto the intermediate transfer belt 116. The image forming apparatus 104 includes four process units 115 respectively corresponding to four colors (e.g., yellow, magenta, cyan, and black). If the decolorable colorant is supplied to the process units 115 from respective toner cartridges, the process units 115 can also perform the image forming process using the decolorable colorant.

The intermediate transfer belt 116 secondarily transfers the developer images, which are primarily transferred from the photoconductive members of the process units 115, onto a sheet in a secondary transfer position T where a secondary transfer roller 117 is arranged.

If the decoloring process is performed, since the developer images are not transferred onto the sheet, the secondary transfer roller 117 and the intermediate transfer belt 116 may be spaced apart when the sheet passes.

In the image forming process mode, the fixing roller 118 comes into press contact with the pressing roller 120 opposed to the fixing roller 118 and fixes a colorant such as a toner, which is secondarily transferred on the sheet, on the sheet with heat and pressure. The fixing roller 118 is heated by heating means such as a heater and can perform a fixing process.

In the decoloring process mode in which the decoloring process is performed, the fixing roller 118 in this embodiment applies heat to the sheet on which the decolorable colorant is fixed and erases the color of the decolorable colorant. Usually, the color of the decolorable colorant disappears at temperature higher than fixing temperature. Therefore, in the decoloring process mode, the fixing roller 118 is heated to decoloring temperature set to temperature higher than the fixing temperature and performs the decoloring process. The fixing temperature and the decoloring temperature are different depending on a composition of a colorant. For example, in the decolorable colorant explained in the first embodiment, the fixing temperature is about 80° C. to 100° C. and the decoloring temperature is temperature higher than the fixing temperature and is about 100° C. to 150° C. A temperature control function for heating the fixing roller 118 to temperature necessary in each of the image forming mode and the decoloring process mode is realized by the processor 106 reading the computer program stored in the memory 108 or the like.

Like the heating belt 26 in the first embodiment, the heating roller 34 in the second embodiment, and the like, the fixing roller 118 in this embodiment has, in order to roughen the surface of the decolorable colorant and eliminate a gloss, very small unevenness on a surface that comes into contact with the sheet. Very small unevenness is formed on the surface of the decolorable colorant by the very small unevenness to prevent the light from being reflected and make the decolored decolorable colorant less conspicuous.

Like the heating belt 26 in the first embodiment and the like, the fixing roller 118 desirably has an Rz value, which indicates the roughness of the surface of the fixing roller 118, equal to or larger than 3.5 μm and equal to or smaller than 6.0 ml. A reason for this is as explained in the first embodiment.

The pressing roller 120 is a rubber roller for securing a nip amount between the pressing roller 120 and the fixing roller 118.

A sheet on which a toner is fixed by the fixing roller 118 and the pressing roller 120 or a sheet subjected to the decoloring process on which the color of the decolorable colorant is erased is discharged to the discharge tray 122.

With the image forming apparatus 104 according to this embodiment explained above, it is possible to perform, with the image forming apparatus that performs the image forming process, the decoloring process for erasing the color of the decolorable colorant while reducing the gloss of the surface of the decolorable colorant. Therefore, it is possible to provide a recycle sheet on which the decolorable colorant after the decoloring process is not conspicuous. In particular, in the case of this embodiment, the image forming apparatus 104 is convenient because the image forming apparatus 104 has the function of the decoloring apparatus.

In the embodiment explained above, the fixing roller 118 and the pressing roller 112 perform the decoloring process. However, means for performing the decoloring process is not limited to this. Like the heating belt 26 in the first embodiment, the image forming apparatus 104 may include a fixing belt of a belt system instead of the fixing roller 118.

EXAMPLES

The embodiments explained above are explained more in detail below with reference to examples. As the examples, decoloring apparatuses (decoloring dedicated apparatuses) or image forming apparatuses including rollers or belts having different levels of surface roughness was prepared. The decoloring process was applied to sheets, on which images are formed with the decoloring colorant, using the apparatuses of the examples and gloss levels in decolored sections were evaluated. It was also evaluated concerning the examples whether the decolorable colorant adhered to the rollers or the belts and whether a jam of a sheet occurred.

The examples and comparative examples for comparison are explained below.

Surface roughness of an area 0.35 $mm^2$ on the belts or the rollers was measured using a laser microscope (VK-9700) manufactured by Keyence Corporation and adopted as a roughness Rz value of the surfaces of the belts or the rollers having very small unevenness.

Example 1

An example 1 is the decoloring apparatus including the configuration of the first embodiment shown in FIG. 1. As the heating belt, a heating belt having a surface formed of an elastic layer of silicone rubber was used. The Rz value of the belt surface was 4.582 μm.

Example 2

An example 2 is the decoloring apparatus including the configuration of the second embodiment shown in FIG. 3. The heating roller was formed by, after applying PTFE resin on the surface of a cored bar and burning the PTFE resin, polishing the surface with sandpaper. The roughness Rz value of the surface of the roller was 3.895 μm.

Example 3

An example 3 is the image forming apparatus including the configuration of the fourth embodiment shown in FIG. 5. However, the image forming apparatus performs the fixing and decoloring processes with the fixing belt system rather than the fixing roller system. The fixing belt was the same as that in the example 1. A fixing belt having a surface formed of an elastic layer of silicone rubber was used. The Rz value of the belt surface was 4.582 μm.

Example 4

An example 4 is the decoloring apparatus including the configuration of the embodiment shown in FIG. 3 as in the example 2. A manufacturing method is the same as that in the example 2. However, the roughness Rz value of the surface of the roller was set to 5.651 μm.

Comparative Example 1

A comparative example 1 is a decoloring apparatus having a configuration same as that in the example 1. However, as the heating belt, a heating belt obtained by coating an elastic layer of silicone rubber with PFA (a copolymer of tetrafluoroethylene and perfluoroalkoxyethylene) was used. An Rz value was 3.152 μm.

Comparative Example 2

A comparative example 2 is a decoloring apparatus having a configuration same as that in the example 1. As the heating belt, a heating belt having a surface formed of an elastic layer of silicone rubber was used. An Rz value was 7.352 Preparation of a Decolorable Colorant and an Image Forming process and a decoloring process applied to a sheet A decolorable colorant to be subjected to the decoloring process by the decoloring apparatuses or the image forming apparatuses in the examples was prepared as explained below.

First, polyester resin having weight average molecular weight Mw of 6300 obtained by subjecting terephthalic acid and bisphenor A to condensation polymerization, rice bran wax as a releasing agent, Neogen R (manufactured by Daiichi Kogyo Seiyaku Co., Ltd.) as an anionic emulsifier, a neutralizer dimethylaminoethanol were mixed at a ratio of 95 parts by weight, 5 parts by weight, 1.0 parts by weight, and 2.1 parts by weight, respectively, using a high-pressure homogenizer and generated as atomized fluid dispersion of a binder resin included in a toner.

Subsequently, as a color material, CVL (Crystal violet lactone) of a leuco dye as a color assuming agent, 4-hydroxybenzoic acid as a color developing agent, and lauric acid-4-benzyloxy phenylethyl as a temperature control agent were mixed at a ratio of 10 parts by weight, 10 parts by weight, and 80 parts by weight, respectively, and heated and fused. The color material was micro-encapsulated by a coacervation method.

10 parts by weight of the micro-encapsulated color material and 90 parts by weight of atomized fluid dispersion of the binder resin and wax were condensed and fused using aluminum sulfate ($Al_2(SO_4)_3$). A fused material was cleaned and dried to obtain toner particles. 3.5 weight % of hydrophobic silica ($SiO_2$) and 0.5 weight % of titanium oxide ($TiO_2$) were externally added and mixed with 100 parts by weight of the particles to obtain a decolorable toner (a decolorable colorant).

The decolorable toner was mixed with a carrier to prepare a two-component developer.

The image forming process was performed using a developer containing the decolorable colorant. As the image forming process, fixing and printing were performed at fixing temperature of 85° C. and fixing speed of 75 mm/s using remodeled e-STUDIO3520C manufactured by Toshiba Tec.

The decoloring process was performed by the decoloring apparatuses or the image forming apparatuses of the examples and the comparative examples. The decoloring process was performed by heating the heating belt (roller) or the fixing belt to 120° C., whereby a sheet was heated. Decoloring time (time in which the sheet is in contact with the decoloring means such as the heating belt) was 0.3 second.

Evaluation test for gloss levels, peeling of a toner, and a jam (1) Test Method

Gloss levels were measured concerning a sheet subjected to the decoloring process by the apparatuses of the examples and the comparative examples using the method explained above. The gloss levels were measured by a gloss meter (VG2000) manufactured by Nippon Denshoku Industries Co., Ltd. in conformity to a specular gloss measuring method (JISff Z 8741). The gloss levels were measured at a light projecting and receiving angle of 60 degrees.

Concerning the peeling of a toner and a jam, it was checked whether a toner adhered to the heating belt (roller) or the fixing belt and whether a jam occurred in the decoloring process in the apparatuses of the examples and the comparative examples.

(2) Test Results

Test results are shown in FIG. 6. In a table of FIG. 6, if the toner did not adhere, A is shown and, if the toner adhered, B is shown. In the table of FIG. 6, if a jam did not occur, A is shown and, if a jam occurred, B is shown.

Concerning the gloss levels, in all the examples 1 to 4, the gloss levels were low and a section where the decolorable colorant after the decoloring process was fixed was not conspicuous. On the other hand, in the comparative example 1, the gloss level was relatively high and light was reflected on the decolored colorant and the decolored colorant was conspicuous.

Adhesion of the toner and a jam did not occur in all the examples. On the other hand, in the comparative example 2, the roughness Rz value of the surface of the heating belt exceeded 6.0. In some cases, the toner peeled from the sheet and adhered to the belt surface or a jam of the sheet occurred.

As explained in detail above, according to the technique described in this specification, it is possible to provide a decoloring apparatus and an image forming apparatus that can perform a decoloring process for reducing a gloss of a decolorable colorant.

While certain embodiments have been described, these embodiments have been presented by way of example only, and are not intended to limit the scope of invention. Indeed, the novel compound described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

What is claimed is:

1. A decoloring apparatus comprising:

a heating rotating member having roughness (Rz) of a surface, which comes into contact with a conveyed sheet, equal to or larger than 3.5 μm and equal to or smaller than 6.0 μm and configured to heat and decolor a decolorable colorant on the sheet; and a pressing member configured to come into press contact with the heating rotating member to form a nip section between the pressing member and the heating rotating member and cooperate with the heating rotating member to nip and convey the sheet.

2. The apparatus according to claim 1, further comprising a heating section configured to heat the heating rotating member.

3. The apparatus according to claim 2, wherein the heating section heats the heating rotating member to temperature equal to or higher than 100° C. and equal to or lower than 150° C.

4. The apparatus according to claim 1, wherein the heating rotating member is an endless belt wound and suspended around plural rollers.

5. The apparatus according to claim 4, wherein at least one of the plural rollers around which the endless belt is wound and suspended includes a heating section configured to heat the endless belt.

6. The apparatus according to claim 4, wherein the endless belt includes a layer formed of at least one of nickel, stainless steel, and polyimide.

7. The apparatus according to claim 1, wherein the heating rotating member is a roller.

8. The apparatus according to claim 7, wherein the roller includes a core material of aluminum or iron.

9. The apparatus according to claim 1, wherein a surface layer section in contact with a printing surface of the heating rotating member is silicone rubber or fluorine resin.

10. A decoloring apparatus comprising:

a heating rotating member configured to heat and decolor a decolorable colorant on a sheet;

a pressing member configured to come into press contact with the heating rotating member to form a nip section between the pressing member and the heating rotating member and cooperate with the heating rotating member to nip and convey the sheet; and a roller pair configured to nip and convey the sheet further on a downstream side in a sheet conveying direction than the nip section, the roller pair having roughness (Rz) of a surface of a roller, which comes into contact with a printing surface of the sheet, of the roller pair equal to or larger than 3.5 μm and equal to or smaller than 6.0 μm.

11. The apparatus according to claim 10, wherein the roller pair is arranged right behind the heating rotating member.

12. The apparatus according to claim 10, wherein a surface layer section of the roller, which comes into contact with the printing surface of the sheet, of the roller pair is silicone rubber or fluorine resin.

13. An image forming apparatus comprising:

a heating rotating member having roughness (Rz) of a surface, which comes into contact with a conveyed sheet, equal to or larger than 3.5 μm and equal to or smaller than 6.0 μm and configured to heat a colorant on the sheet and fix the colorant on the sheet or decolor the colorant; and a pressing member configured to come into press contact with the heating rotating member to form a nip section between the pressing member and the heating rotating member and cooperate with the heating rotating member to nip and convey the sheet.

14. A decoloring method in a decoloring apparatus including: a heating rotating member configured to heat and decolor a decolorable colorant on a sheet; and a pressing member configured to come into press contact with the heating rotating member to form a nip section between the pressing member and the heating rotating member and cooperate with the heating rotating member to nip and convey the sheet, the method comprising bringing a member having roughness (Rz) of a surface equal to or larger than 3.5 μm and equal to or smaller than 6.0 μM into press contact with a printing surface of the sheet printed with a decolorable colorant in the nip section or a position further on a downstream side in a sheet conveying direction than the nip section.

15. The method according to claim 14, wherein the decoloring apparatus further includes a heating section configured to heat the heating rotating member.

16. The method according to claim 15, wherein the heating section heats the heating rotating member to temperature equal to or higher than 100° C. and equal to or lower than 150° C.

17. The method according to claim 14, wherein the heating rotating member is an endless belt wound and suspended around plural rollers.

18. The method according to claim 17, wherein at least one of the plural rollers around which the endless belt is wound and suspended includes a heating section configured to heat the endless belt.

19. The method according to claim 17, wherein the endless belt includes a layer formed of at least one of nickel, stainless steel, and polyimide.

20. The method according to claim 14, wherein the heating rotating member is a roller.

* * * * *